US005782582A

United States Patent [19]

Oliver et al.

[11] Patent Number: 5,782,582

[45] Date of Patent: Jul. 21, 1998

[54] FILLING IN A HOLLOW IN THE GROUND

[75] Inventors: William Robert Oliver, Isle of Wight; Anthony Benjamin Di Stefano, Kent, both of England

[73] Assignee: Cordek Limited, United Kingdom

[21] Appl. No.: 513,958

[22] PCT Filed: Mar. 10, 1994

[86] PCT No.: PCT/GB94/00468

§ 371 Date: Nov. 24, 1995

§ 102(e) Date: Nov. 24, 1995

[87] PCT Pub. No.: WO94/20695

PCT Pub. Date: Sep. 15, 1994

[30] Foreign Application Priority Data

Mar. 11, 1993 [GB] United Kingdom ..... 9304981
Jan. 14, 1994 [GB] United Kingdom ..... 9400661

[51] Int. Cl.[6] ..... E02D 29/02

[52] U.S. Cl. ..... 405/262; 405/270; 52/169.2

[58] Field of Search ..... 405/128, 129, 405/262, 52, 54, 270, 289, 266; 52/4, 169.7

[56] References Cited

U.S. PATENT DOCUMENTS

| | | | |
|---|---|---|---|
| 2,882,714 | 4/1959 | Gagle et al. | 405/270 X |
| 3,024,470 | 3/1962 | Baker | 52/169.7 |
| 3,415,022 | 12/1968 | Schaefer et al. | 52/169.7 |
| 3,419,916 | 1/1969 | Schankler | 52/169.7 X |
| 3,549,418 | 12/1970 | Devine et al. | 405/289 X |
| 3,891,041 | 6/1975 | Friedland et al. | 52/169.7 |
| 4,448,571 | 5/1984 | Eckels | 405/262 X |
| 4,661,023 | 4/1987 | Hilfiker et al. | 405/262 |
| 4,718,792 | 1/1988 | Louis | 405/262 |
| 4,904,124 | 2/1990 | Egan | 405/262 |
| 4,917,537 | 4/1990 | Jacobson | 405/270 X |
| 5,120,161 | 6/1992 | Faussone | 405/129 |

FOREIGN PATENT DOCUMENTS

| | | | |
|---|---|---|---|
| 22110/92 | 9/1992 | Australia . | |
| 0174253A | 3/1986 | European Pat. Off. . | |
| 3716496 | 11/1988 | Germany | 415/129 |
| 980960 | 1/1965 | United Kingdom . | |
| 1453537 | 10/1976 | United Kingdom . | |
| 2116600 | 9/1983 | United Kingdom . | |
| 2202874 | 10/1988 | United Kingdom . | |
| 2239036 | 6/1991 | United Kingdom . | |
| PCT/CA91/00178 | 12/1991 | WIPO . | |

OTHER PUBLICATIONS

Colin J.F.P. Jones, "Earth Reinforcement and Soil Structures," 1985, pp. 66–68.

MMG Civil Engineering Systems Ltd. advertisment, Aug. 1991, 1 page.

Netlon Ltd., "Construction Sequence for Reinforced Soil Retaining Walls," Sep. 1992, 2 pages.

*Primary Examiner*—Tamara L. Graysay
*Assistant Examiner*—Frederick L. Lagman
*Attorney, Agent, or Firm*—Moore & Hansen

[57] ABSTRACT

A hollow in the ground is filled in by positioning a base facing unit (10) adjacent a side of the hollow (29), positioning a plurality of further facing units (1) extending upwardly from the first facing unit (1), filling in the gap between the facing (20) and the side of the hollow (29), and filling in the remainder of the hollow in the ground. The facing (20) has a smooth face to prevent damage to a liner (26) of impervious material that is laid over the facing (20) to prevent transfer of pollutants from the material in the hollow. Adjacent facing units (1) are held in interlocking engagement by tongues (21) which are anchored by tethers (30) to the material in the gap between the facing (20) and the side of the hollow (29).

10 Claims, 3 Drawing Sheets

FILLING IN A HOLLOW IN THE GROUND

Figure 1A:
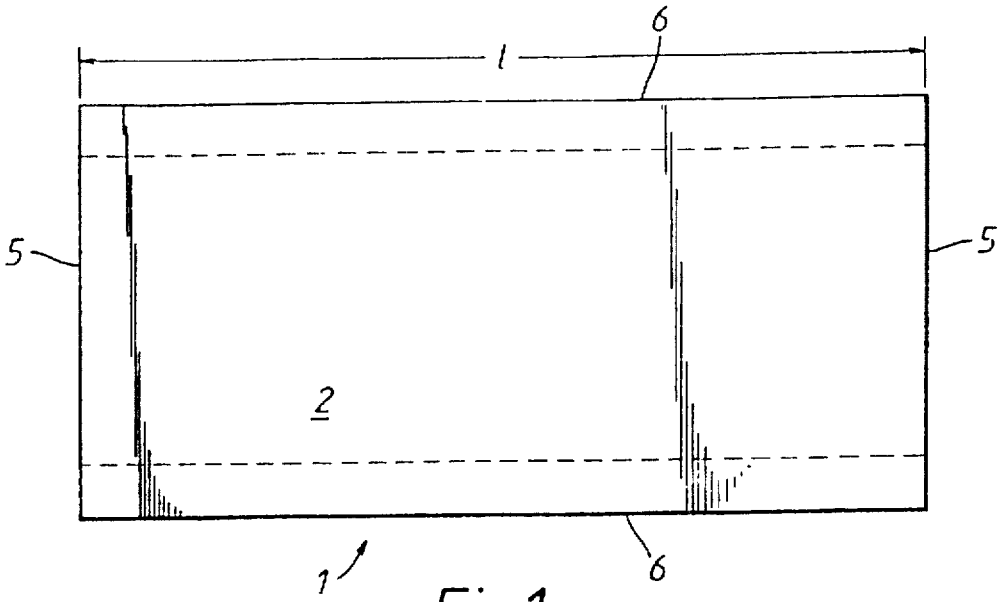

The invention relates to the filling in of a hollow in the ground, for example, a quarry. More particularly, the invention relates to a method of filling in a hollow in the ground, to a method of providing a facing for a slope, to a facing providing a smooth face for a side of a hollow, to a facing unit and to a facing assembly for a slope.

It is sometimes necessary to provide a facing for a ground slope. For example, it may be necessary to provide the walls of a quarry, which are usually irregular, with a facing before the quarry is filled in. A layer of plastics material such as polyethylene can then be laid over the bottom of the quarry and the facing to prevent contaminants from material with which the quarry is filled, from entering the water course. Without a suitable facing the plastics material would be likely to be punctured.

Conventional methods of building a facing for a slope involve building formwork generally of steel or timber at the required angle adjacent to the slope, and holding the formwork in that position whilst the gap between the formwork and the slope is filled in with a suitable material. A number of problems arise in the conventional method: the formwork is heavy and unwieldy and is thus difficult to position correctly; a crane may even be required to install the formwork. Walls of a quarry are often not straight and each time the direction of the formwork has to be altered the construction becomes especially complicated. Furthermore, the known arrangements provide a facing having a rough face which tends to puncture the lining, which will allow contaminants to penetrate the facing from the material with which the quarry is filed.

A further arrangement that has been proposed in GB 2 239 036 comprises an arrangement in which a layer of impermeable plastics material is sandwiched between vertical inner and outer walls, each wall being formed of stacked gabions having wire netting sides. The gabions are, however, heavy and unwieldy and it is necessary to provide a protective fabric lining for the plastics layer before placing it against the wire sides of the gabions.

It is an object of the present invention to provide a method of providing a facing for a slope, a facing assembly for facing a slope, a slope facing and a facing unit, which avoid or mitigate the problems referred to above.

According to the invention there is provided a method of filling in a hollow in the ground in which a plurality of lightweight facing units are positioned over a side of the hollow to provide a smooth face to the side, a liner is placed over the smooth face and the hollow is filled in with material, the liner obstructing the transfer of pollutants from the filling material into the side of the hollow.

As the purpose of the liner is to obstruct the transfer of pollutants from the filling material into the side of the hollow, the feature that the facing provides a smooth face is advantageous, as the likelihood of the liner being pierced by rough or protruding parts of the facing is greatly decreased, and thus transfer of pollutants is prevented. The liner may thus be laid directly on the smooth face without the need for a protective layer. Because the facing units are lightweight, they can be carried and positioned by workmen without any need for mechanical aid.

The positioning of the lightweight facing units over the side of the hollow preferably comprises the steps of positioning a first facing unit at the bottom of the side of the hollow, and building, in a plurality of steps, a facing that extends upwardly from the first facing unit, each of the plurality of steps comprising positioning a further facing unit on top of, and in interlocking engagement with, a facing unit below. Because the units interlock, it is possible to provide a facing inclined at an angle to the vertical which can increase considerably the volume of the part of the hollow to be filled in with material. Furthermore, where a hollow has sides inclined to the vertical, the facing can be built substantially parallel to the sides of the hollow. The facing may also be built up simply and securelv in steps, without the need for complex support structures.

The facing is preferably spaced from the slope and the gap formed between the facing and the slope is preferably filled in with material as the facing is built upwards. Where the side of the hollow is inclined to the vertical, it is especially advantageous to build a facing also inclined to the vertical, preferably substantially parallel to the sides of the hollow, since the amount of material for filling in the gap between the facing and the sides of the hollow, which material must be inert and uncontaminated, can be minimised, and the volume of the main part of the hollow to be filled in with material can be maximised. Furthermore, et is unnecessary to support the facing with additional complicated structures during the filling in of the gap between the facing and the slope. Before each of the plurality of steps the gap formed between the facing and the slope is preferably filled in with material. The gap is preferably filled in with material substantially to the level of the top of the facing, and a reinforcing mat is preferably laid over the top of the filled in gap. The reinforcing mat, which may be a sheet of geogrid (a mat in the form of a flexible grid for reinforcing soil and granular material), provides an anchor for the facing.

The region adjacent to the side of the facing remote from the slope is preferably also filled in with material.

The interlocking engagement between the facing units may be of the tongue and groove type.

Adjacent facing units are preferably held in interlocking engagement by an interlocking member which is interposed between and interlockingly engages each facing unit. As the locking member is separate from the facing units, it may be made of a material having especially good stress-bearing properties and the facing units may be made of a weaker material, thereby enabling the cost and weight of the facing units to be reduced.

The facing is preferably anchored by means of a plurality of tethers, one end of each tether being anchored in the material with which the gap between the facing and the side of the hollow is filled. Each tether is preferably secured at the other end to the facing at a junction between adjacent facing units. Each tether is preferably secured to an interlocking member. A simple method of retaining the facing in shape, and preventing buckling, is thus provided. The tension of the tethers may be adjustable, allowing the shape of the facing to be adjusted. Once the hollow has been filled in, the facing is held in position by, and between the material filling the hollow and the material filling the gap between the facing and the side of the hollow.

A portion of the reinforcing mat may be positioned between interlocking parts of the facing units.

Usually, a plurality of first facing units are positioned side by side at the bottom of the side of the hollow and each of the plurality of steps preferably comprises positioning a plurality of further facing units on top of, and in interlocking engagement with, facing units below. The size of the facings that can then be provided is unlimited. Facing units positioned side by side are preferably in direct or indirect interlocking engagement with one another. For example, there may be a plurality of locking members each of which engages at least two facing units positioned side by side and at least one facing unit immediately above or below said at least two facing units.

The liner may comprise a plurality of strips of impervious material, each strip being placed on the smooth face adjacent to, and overlapping, the previous strip. The liner can render the facing impervious to prevent pollutants passing through the facing.

According to a further aspect of the invention there is provided a method of providing a facing for a slope, comprising positioning a first facing unit at the bottom of the slope, and building, in a plurality of steps, a facing that extends upwardly from the first facing unit, each of the plurality of steps comprising positioning a further facing unit on top of, and in interlocking engagement with, a facing unit below.

According to a still further aspect of the invention there is provided a method of providing a facing for a ground slope, comprising positioning a plurality of first facing units at the bottom of the slope and positioning further facing units on top of the first units, each of the facing units being lightweight and made of a plastics material.

According to the invention there is further provided a facing providing a smooth face for a side of a hollow, built from a first, lightweight facing unit, a plurality of further lightweight facing units extending upwardly from the first facing unit, and a liner of impervious material positioned over the smooth face.

There is preferably further provided a locking member for retaining adjacent facing units in interlocking engagement. The locking member may comprise a tongue and each facing unit may have a groove for engagement with the tongue.

Although reference is made to a slope suggesting that the facing assembly is inclined to the vertical, as will normally be the case, the "slope" may be vertical.

The first facing unit preferably comprises a base facing unit having a base portion and a facing portion in interlocking engagement with an adjacent facing unit. The facing portion preferably has a top which is inclined to the bottom of the base portion, thereby determining the angle at which the facing extends relative to the bottom of the base portion. The need for a complex support structure for retaining the facing at a desired angle is thereby removed.

The facing units may be formed of a lightweight plastics material. The facing units are preferably formed of expanded polystyrene. As a result, the facing units are especially lightweight and easily manoeuvred. Furthermore, expanded polystyrene may be cut to provide a smooth face having few, or no, irregularities. The units can be pre-formed or cut on site using hand tools. Any defects are easily repaired by use of polystyrene and adhesives. A further advantage of using expanded polystyrene is that the surface of the units is relatively soft and easily deformed so that irregularities in the surface presented to a liner by the facing can be removed or reduced by local deformation of the facing surface.

The facing units may have different shapes to allow for variations in a slope. For example, the gradient of the slope may change or the slope may turn a corner.

A facing for a slope can be assembled from a facing assembly as described above with adjacent facing units in interlocking engagement. There is preferably further provided a reinforcing mat, an edge of which may be secured between interlockingly engaging adjacent facing units. The reinforcing mat may be a geogrid.

The facing is preferably built from a plurality of first facing units positioned side by side and a plurality of further facing units above the first facing units. The facing units that are side by side are preferably in direct or indirect interlocking engagement.

There may further be provided a sheet of impervious material positioned over a surface of the facing remote from the slope. The impervious material of the liner may be a plastics material.

The facing may be provided by a method as described above.

According to a further aspect of the invention there is provided a facing for a slope comprising a first facing unit and a plurality of further facing units on top of the first unit, each further facing unit being in interlocking engagement with an adjacent facing unit below, wherein the facing units are formed of expanded polystyrene.

According to a still further aspect of the invention there is provided a facing for a slope comprising a plurality of first facing units positioned side by side and a plurality of further facing units on top of the first units, each further facing unit being in interlocking engagement with an adjacent facing unit below.

According to yet a further aspect of the invention there is provided a facing for the sides of a hollow in the ground, built from a plurality of lightweight facing units providing a smooth face for the sides, and having a liner placed over the smooth face, the liner being formed of impermeable material.

According to a further aspect of the invention there is provided a facing unit providing, together with a plurality of other facing units, a facing for a ground slope, the facing unit comprising a block of expanded polystyrene material and having projections and/or recesses formed on upper and lower faces thereof to enable the unit to be positioned in interlocking engagement with similar units above and below.

According to a further aspect of the invention there is provided a facing assembly for a slope comprising a first facing unit and a plurality of further facing units for building a facing extending upwardly from the first facing unit, wherein each further facing unit is shaped for interlocking engagement with an adjacent facing unit below it.

There may be further provided an interlocking member for retaining adjacent facings units in interlocking engagement.

Figure 1B:
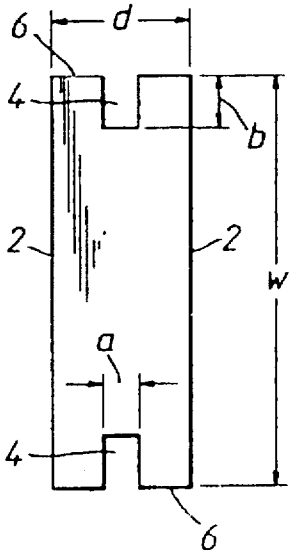
Figure 1C:
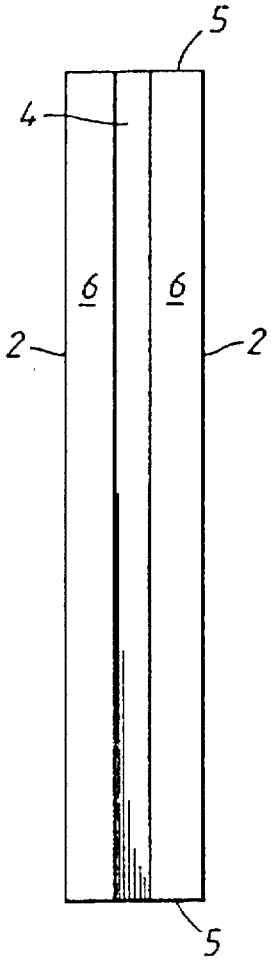
Figure 2A:
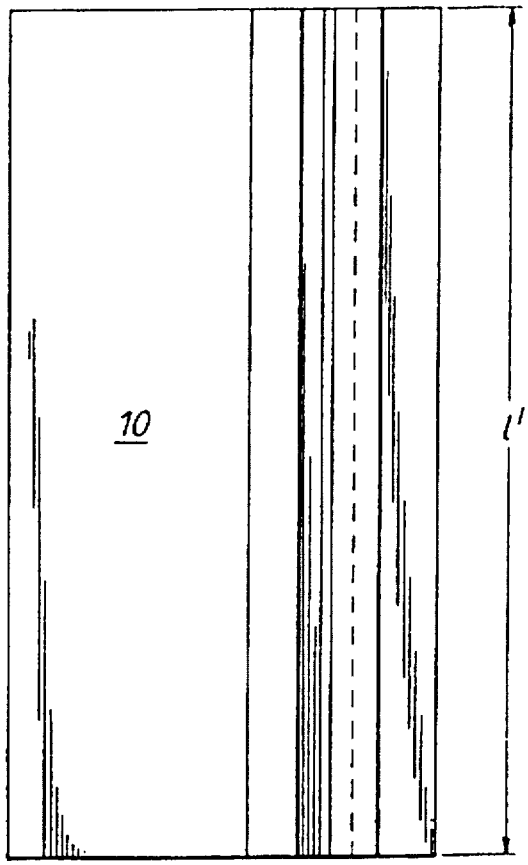
Figure 2B:
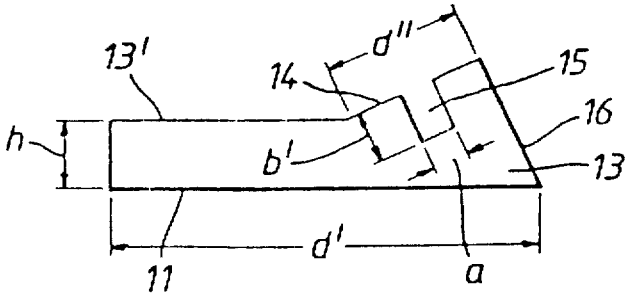

By way of example an embodiment of the invention will now be described with reference to the accompanying drawings, of which:

FIG. 1*a* is a side view of a facing unit;

FIG. 1*b* is an end view of the facing unit;

FIG. 1*c* is a plan view of the facing unit;

FIG. 2*a* is a plan view of a base facing unit;

FIG. 2*b* is an end view of the base facing unit; and

Figure 3:
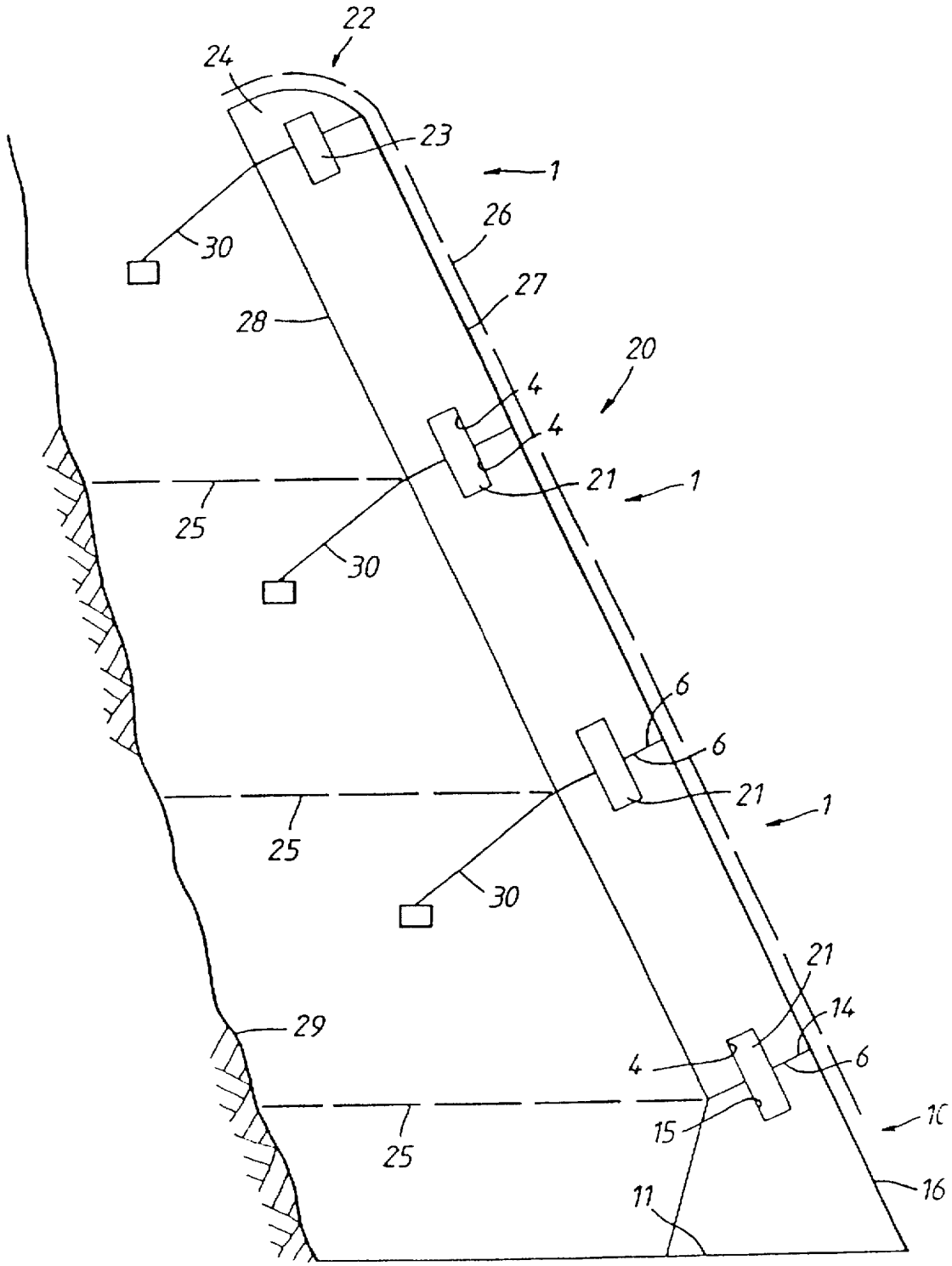

FIG. 3 is a an end view of an assembled facing embodying the invention.

The facing unit shown in FIGS. 1*a*, 1*b* and 1*c* comprises an elongate cuboidal block having two broad, parallel, rectangular faces 2, a pair of opposing, relatively short, narrow faces 5, and a pair of opposing, relatively long, narrow faces 6. A groove 4 of rectangular cross section is provided centrally in each of the opposing faces 6 and runs the whole length of each of those faces.

In FIGS. 1*a*, 1*b* and 1*c* the length of the facing unit 1 is referenced "l", the width is referenced "w" and the depth is referenced "d". The width and depth of each groove are referenced "a" and "b" respectively. In a particular example of the invention the dimensions of the facing unit 1 are as follows: l=1200 mm, w=600 mm, d=200 mm, a=60 mm and b=75 mm.

The block is cut or moulded to the required shape, and is formed of expanded polystyrene.

FIGS. 2*a* and 2*b* show a base facing unit 10. The base facing unit has a broad, rectangular bottom face 11 and comprises a raised end facing portion 13 and a foot portion 13' extending from the facing portion 13. The facing portion 13 includes an upper face 14 extending at an inclined angle to the bottom face 11, and a groove or rebate 15 of rectangular cross-section centrally disposed in and running the whole length of the upper face 14. As shown in FIG. 2*b*, the groove extends inwardly from the face 14 in a direction perpendicular to the face 14. A further inclined face 16, perpendicular to the upper face 14, joins the upper face 14 and the bottom face 11.

The length of the base facing unit 10 is referenced "l'", the depth of the base facing unit 10 is referenced "d'", the depth of upper face 14 is referenced "d'", and the height of the unit 10 away from the end facing portion 13 is referenced "h". The groove is referenced "a'" and depth "b'". When the facing is assembled it is especially desirable to match the depth d" of the upper face 14 with the depth d of the facing unit 1, and at least the width a, a' of the respective grooves. Thus, in the particular example of the invention discussed in respect of the facing unit 1 of FIGS. 1*a*, 1*b* and 1*c*, the dimension of the base facing unit 10 is as follows: l'=1200 mm, d'=600 mm, d"=200 mm, h=100 mm, a'=60 mm and b'=75 mm.

The base facing unit 10 is cut or moulded to the required shape, and is formed of expanded polystyrene.

An assembled facing generally denoted as 20 is shown in side elevation in FIG. 3. Adjacent facing units 1 interlockingly engage one another to provide a facing 20 with an outer surface 27 and an inner surface 28, the lowermost facing unit 1 interlockingly engaging the base unit 10. Adjacent facing units 1 are positioned with their grooves 15 running substantially horizontally, adjacent faces 6 being squarely in abutment with their respective grooves 4 aligned. Adjacent facing units 1 are interlocked by means of an interlocking member, in the form of a tongue 21. The outer and inner surfaces 27, 28 of the facing 20 thus comprise the aligned broad faces 2 of each of the facing units. The tongue 21 is configured to fit in the space formed by the aligned grooves of adjacent facing units 1. The tongue 21 runs the whole length of the grooves 4, and in the particular example of the invention discussed in respect of FIGS. 1 and 2, has dimensions as follows: length=1200 mm, width (corresponding to groove width a)=60 mm, depth (corresponding to the depth 2*b* of two adjacent grooves) =150 mm. The tongue may be a length of timber, or it may be formed from plastics material, including expanded polystyrene and other materials, or metal.

The lowermost facing unit 1 is positioned with its lower grooved face 6 squarely in abutment with the upper face 14 of the base unit 10, and the respective grooves 4, 15, aligned. The facing unit 1 is retained in position with respect to the base facing unit 10 by means of another tongue 21, in a manner similar to that described above, and the angle at which the facing extends from the base portion is determined by the angle of upper face 14 to the base face 11. As the facing units 1 are cuboidal, the angle of the facing is perpendicular to that of the upper face 14 of the base facing unit 10. Since the groove 15 extends downwardly into the upper face 14 of the base facing unit 10, perpendicular to the angle of inclination of the upper face 14, the facing 20 is further retained at the required angle by means of the tongue 21 retaining the lowermost facing unit and the base facing unit squarely, in interlocking engagement. The inclined face 16 of the base facing unit 10 extends parallel to and forms part of the outer surface 27 of the facing 20.

The facing units 1, base facing unit 10 and tongue 21 are all sized and shaped accurately such that the assembled facing has a substantially smooth and planar outer surface 27 where desired.

An end unit generally indicated at 22 is positioned against the upper grooved face 6 of the uppermost facing unit 1. The end unit 22 comprises a projection 23 shaped to fit the groove 4 of the upper grooved face 6 of the uppermost facing unit 1 and a top 24 shaped to provide a suitable top for the facing 20. In FIG. 3 the top 24 is shown having a partly round profile.

FIG. 3 also shows a plurality of sheets of geogrid 25, which are laid adjacent to the facing; the sheets of geogrid 25 are discussed in more detail below. A sheet of polyethylene 26 or other impervious material is shown laid across the outer surface 27 of the facing wall.

A plurality of tethers 30 are provided for anchoring the facing in position. Each tether is secured at one end to a tongue 21, for example, by passing the tether through one or more holes in the tongue 21 and fastening it appropriately. The tethers 30 are discussed in more detail below.

In order to form a facing as shown in FIG. 3, for example for the walls of a quarry, the base facing unit is first positioned at the base of a quarry wall 29, and spaced therefrom by, for example, a distance of 2 inches with the base face 11 resting substantially horizontally on a suitable, substantially flat surface. The base facing unit 10 is secured in position by pinning the unit 10 to the flat surface (for which purpose the unit 10 may be provided with suitable holes), or by other means. The means of securing the base facing unit 10 is not shown in the figures. The base facing unit 10 is spaced from the quarry wall 29 a sufficient distance that the facing 20 extending from the base facing unit will, when assembled, be clear of any irregularities such as stones projecting from the quarry wall 29. The base facing unit 10 shown in FIG. 3 is a variant of that shown in FIGS. 2*a*, 2*b* in that there is no foot portion 13' provided. A sheet of geogrid 25 is laid across the space between the base facing unit 10 and the quarry wall 29. A tongue 21 is inserted into the groove 15 in the upper face 14 of the base facing unit 10. One or more tethers, 30 are secured at one end to the tongue 21, the or each other end is anchored to the quarry floor by a peg or other suitable means.

The space between the base facing unit 10 and the quarry wall 29 is then filled in by pouring suitable filling in material up to the level of the top of the unit 10. The material is, if necessary, compacted.

A further sheet of geogrid 25 is next placed across the top of the filled in space, extending towards the quarry wall 29, such that the geogrid sheet 25 covers a substantial portion of the filled in space between the groove 15 and the quarry wall 29. In each case, the geogrid sheet 25 provides added stability for the filling in material.

A first facing unit 1 is next positioned with a narrow grooved face 6 squarely abutting the upper face 14 of the base facing unit 10 with the respective grooves 4, 15 aligned such that tongue 21 fits into the downwardly facing groove 4 of the first facing unit 1. As discussed above, the tongue 21 is dimensioned to form an accurate fit in the space formed by the aligned grooves 4, 15, and thus the abutting faces of the units are in contact across substantially all of their respective surfaces 6, 14.

The tongue 21 serves to retain the first facing unit securely in position against the base facing unit 10.

After the first facing unit 1 has been positioned, a further tongue 21 is inserted into the upwardly facing groove 14 of the unit. As in the case of the base facing unit 10, one or more tethers are secured at one end to the tongue 21. The or each other end of the tether is anchored to the filling in material, for example, by means of a peg. The length of the tether is adjustable, for example, by means of a buckle. The tether is preferably arranged at approximately 45° to the horizontal. The space between the facing 20 so far formed and the quarry wall 29 is filled in by pouring further suitable filling in material into the gap, up to the top of the inner surface 28 of the facing 20 so far formed. Once again, the material is, if necessary, compacted. In order to ensure that the facing has a planar face, the gap between the facing 20 and the quarry wall 29 can be filled to half height, and the tether can be anchored to the filling in material at that stage, approximately half-way between the facing 20 and the quarry wall. The filling in material is then compacted. The material in the region between the anchoring point of the tether and the quarry wall is compacted using a vibrating roller, and in the less accessible region between the anchoring point of the tether and the facing, by a hand compactor. The length of the tether is adjusted to ensure that the topmost facing unit extends at the correct angle such that the facing has a planar face. One manner of achieving that is to adjust the length of the tether to be too little prior to compacting. When the filling in material is compacted, the topmost facing unit is pushed outwards. The tension of the tether is then reduced until the facing unit is once more in alignment such that the facing has a planar face. The remainder of the gap is then filled, and the filling in material compacted, as described above.

A further geogrid sheet 25 is then laid over the top surface of the filling in material, and a second facing unit is added to the facing in the same way as the first facing unit. If additional stability is required, extra geogrid sheets 25 may be laid at different heights, for example, when the gap is filled to half the height of the facing, the material may be compacted, a geogrid sheet laid, and the filling in may be continued. Because the principal purpose of the facing itself is to provide a smooth face for a liner, because of the nature of the building materials, and because, in due course, the facing is supported and held in position by the filling in material on both sides, it is not normally intended that the facing fulfil any major structural role at any stage. Accordingly, it is desirable to reinforce the filling in material in the gap between the facing and the quarry wall to such an extent that the material is self-supporting in position, and relies as little as possible on the facing to be retained in position.

The process of positioning a geogrid sheet 25, tongue 21 anchored by tethers 25, and a further facing unit 1, followed by filling in of the space thus formed between the quarry wall and the facing units is repeated until a facing of a required height is obtained.

An end unit 22 is positioned on top of the uppermost facing unit 1, also being retained in position by a tongue 21.

Sheets 26 of polyethylene (HDPE), polypropylene or other impervious material are laid in strips, for example, 2 mm thick substantially horizontally over the outer surface 27 of the facing 20 as the facing is formed. Adjacent strips overlap and are glued or heat welded together to form an impervious seal. The floor of the quarry is also covered with polyethylene, polypropylene or a similar material in a known manner. As a result of the sheets of impervious material laid over the facing and floor of the quarry, the transfer through the facing of contaminants from the material with which the quarry is filled is prevented. The liner may comprise a geosynthetic liner system comprising a layer of polyethylene or other impervious material, a geonet and then a HDPE geotextile. Such an arrangement provides a drainage curtain and allows upward gas flow.

The quarry is filled in in stages as the facing is formed. For example, when a facing has been built up to 3 metres all around the quarry, the quarry may be filled in. Filling in of a part of the quarry which has been faced up to a required level may begin whilst facing of the remainder of the quarry to that level is still going on. It is preferable that the quarry is filled in at such a rate that no more than one layer of facing units is left exposed at any time. As a result, suitable support is provided for the facing as it is constructed.

The filled in quarry, when finished, thus has a suitable lining to prevent contaminants in the filling in material from entering the watercourse.

Because the facing 20 is formed unit by unit, and because each unit is lightweight, the need for complicated shuttering or a crane is removed. The polystyrene material of the facing is advantageous both because of its light weight and because it provides a smooth face that does not damage or penetrate the polyethylene sheet 26 and that is relatively soft and able to deform locally, if required. Thus contaminants are successfully prevented from entering the watercourse through, for example, tears in the sheet 26.

Although in the description above, in the interests of simplicity, reference has been made to only one facing unit in each tier, it will be appreciated that in practice there are in each tier of the facing a series of facing units placed side by side. The facing may be laid in a series of side by side strips each comprising a base facing unit 10 and a series of facing units 1 extending therefrom, to provide a facing for the whole of a slope. In the case of a quarry or similar land formation where the slope comprises a number of walls meeting at various angles, the ends of the base facing units 10 and/or facing units 1 may be shaped so as to match the angles; that is especially easy in the case of expanded polystyrene facing units as they are easy to cut to shape.

It will be recognised that the base facing units may be shaped to allow facings extending at a wide range of angles to the horizontal, simply by altering the angle at which the upper face 14 extends to the bottom face 11. Where the gradient of the quarry wall is different at different heights up the wall, it is possible to provide a facing having a corresponding variation in gradient by completing a first facing including an end unit 22 up to the level of the quarry wall at the first gradient change, then positioning a further base facing unit suitably angled to correspond to the new gradient, and constructing a further facing in the usual manner extending therefrom. The method can be repeated with further suitably angled base facing units where required.

A further advantage of forming the units from polystyrene is that they may be cheaply and easily formed to shapes within small tolerances, providing the advantages of a smooth and planar facing, as discussed above.

Adjacent facing strips may interlock by means of interlocking parts formed on adjacent ends of facing units, or by positioning the tongues 21 such that a single tongue extends across the interface between adjacent strips. Alternatively, facing units may be arranged in a staggered pattern as bricks are in an ordinary brick wall; for example, a facing unit may be positioned on top of half of each of two side by side facing units below. Tethers may be provided anchored at one end of the junction between side by side facing units, for example, halfway up the units, for additional stability. Adjacent side by side units may be in interlocking engagement by means of a vertical tongue and groove arrangement similar to the horizontal tongue and groove arrangement described hereabove. In that case, the tethers may be anchored to the vertical tongues, for example, halfway up the tongues. Alternatively, the units therebetween may be shaped to enable interlocking engagement without the need for additional parts.

Although it is a preferred feature that the units are formed of expanded polystyrene, the units could be formed of other materials. For example, lightweight hollow blocks of non-expanded plastics material could be used.

Although in the figures the grooves 4, 15 are shown situated centrally in their respective faces, in a variation of the facing units the groove may be situated off-centre, in particular, closer to the side of the unit providing a face for the facing. Such an arrangement will give the facing additional strength, as it will provide added resistance to any tendency of the facing to fail at a junction between adjacent units. The groove might be moved, for example, 20 mm off-centre.

We claim:

1. A facing having a smooth face for a side of a hollow, built from a first, lightweight, plastic facing unit, a plurality of further lightweight, plastic facing units extending upwardly from the first facing unit, and a liner of impervious material positioned over the smooth face, said liner being impervious to containments or pollutants, wherein an interlocking member is interposed between adjacent facing units and retains them in interlocking engagement, the interlocking member comprising a tongue of greater load and stress strength than each facing unit, and each facing unit having a groove for engagement with the tongue.

2. A facing as claimed in claim 1 in which the facing is anchored by means of a plurality of tethers.

3. A facing having a smooth face for a side of a hollow, built from a first, lightweight, plastic facing unit, a plurality of further lightweight, plastic facing units extending upwardly from the first facing unit, and a liner of impervious material positioned over the smooth face, said liner being impervious to containments or pollutants, wherein the facing is anchored by means of a plurality of tethers, one end of each of the plurality of tethers being secured to the facing at a junction between adjacent facing units.

4. A facing as claimed in claim 3 in which an interlocking member is interposed between adjacent facing units and retains them in interlocking engagement.

5. A facing as claimed in claim 4 in which the interlocking member comprises a tongue of greater load and stress strength than each facing unit, and each facing unit has a groove for engagement with the tongue.

6. A facing as claimed in claim 3 wherein an interlocking member is interposed between adjacent facing units and retains the adjacent facing units in interlocking engagement; and each tether is secured to an interlocking member.

7. A facing as claimed in claim 1 or claim 3 in which each further facing unit is in interlocking engagement with an adjacent facing unit below it.

8. A facing as claimed in claim 1 or claim 3 in which the facing units are formed of expanded polystyrene.

9. A facing as claimed in claim 1 or claim 3 in which there is further provided a reinforcing mat.

10. A facing as claimed in claim 9 in which the reinforcing mat is a geogrid.

* * * * *